US005589033A

United States Patent [19]

Tikka et al.

[11] Patent Number: 5,589,033

[45] Date of Patent: Dec. 31, 1996

[54] PRODUCTION OF PREHYDROLYZED PULP

[75] Inventors: Panu Tikka; Kari Kovasin, both of Rauma, Finland

[73] Assignee: Sunds Defibrator Pori OY, Finland

[21] Appl. No.: 242,617

[22] Filed: May 13, 1994

[30] Foreign Application Priority Data

Jan. 24, 1994 [FI] Finland ..... 940332

[51] Int. Cl.[6] ..... D21C 1/06; D21C 3/02

[52] U.S. Cl. ..... 162/84; 162/19; 162/29; 162/52; 162/72; 162/37

[58] Field of Search ..... 162/19, 29, 5, 162/37, 41, 52, 72, 82, 83, 84

[56] References Cited

U.S. PATENT DOCUMENTS

| | | | |
|---|---|---|---|
| 982,379 | 1/1911 | Marshall | 162/82 |
| 2,701,763 | 2/1955 | Sivola | 162/82 X |
| 3,145,135 | 8/1964 | Robertson et al. | 162/43 |
| 3,243,341 | 3/1966 | Lang | 162/237 |
| 3,413,189 | 1/1965 | Backlund | 162/29 |
| 3,530,034 | 9/1970 | Erickson | 162/19 |
| 4,174,997 | 11/1979 | Richter | 162/246 X |
| 4,436,586 | 3/1984 | Elmore | 162/19 |
| 5,053,108 | 10/1991 | Richter | 162/237 |
| 5,183,535 | 2/1993 | Tikka | 162/19 |
| 5,338,366 | 8/1994 | Grace et al. | 127/37 |
| 5,346,591 | 9/1994 | Henricson | 162/249 |

FOREIGN PATENT DOCUMENTS

| | | | |
|---|---|---|---|
| 0520452 | 6/1992 | European Pat. Off. . | |
| 44-515 | 11/1971 | Finland | D21C 3/26 |
| 9412719 | 12/1993 | WIPO . | |

OTHER PUBLICATIONS

Ronald G. MacDonald, Ed., "The Pulping of Wood," *Pulp and Paper Manufacture*, Sec. Ed., vol. I, pp. 422–427, McGraw–Hill Book Company.

Sven A. Rydholm, "Multistage Cooking Processes," *Pulping Processes*, pp. 649–672, Interscience Publishers, 1965.

*Primary Examiner*—Donald E. Czaja
*Assistant Examiner*—Jose A. Fortuna
*Attorney, Agent, or Firm*—Lerner, David, Littenberg, Krumholz & Mentlik

[57] ABSTRACT

Processes for preparing pulp from lignin-containing cellulosic material are disclosed including a prehydrolysis step followed by neutralizing hydrolysate and the prehydrolyzed cellulosic material in the reactor with alkaline neutralizing liquor, removing the neutralized hydrolysate from the reactor and delignifying the neutralized prehydrolyzed cellulosic material with alkaline cooking liquor containing sodium sulfide and sodium hydroxide.

28 Claims, 1 Drawing Sheet

PRODUCTION OF PREHYDROLYZED PULP

FIELD OF THE INVENTION

The present invention relates to a process for the production of pulp from lignocellulose-containing material. More particularly, the present invention relates to the production of pulp in which hemicellulose is hydrolyzed into hydrolysate, and lignin is dissolved by a kraft cooking method for liberating cellulose fibers. Still more particularly, the present invention relates to a process for the production of a pulp which has a high content of alpha cellulose and can be used e.g. as dissolving pulp.

BACKGROUND OF THE INVENTION

Traditionally, there are basically two processes for the production of special pulps having a high content of alpha cellulose. These include far-extended acidic bisulfite cooking, and prehydrolysis-sulfate (kraft) cooking. The former was developed at the beginning of the 20th century, and the latter in the 1930's, see e.g. Rydholm, S. E., Pulping Processes, pp. 649 to 672, Interscience Publishers, New York, 1968. The basic idea in both processes is to remove as much hemicellulose as possible from cellulose fibers in connection with delignification, so as to obtain a high content of alpha cellulose. This is essential because the various end uses of such pulps, dissolving pulp for instance, do not tolerate short-chained hemicellulose molecules with a randomly grafted molecular structure.

In the traditional sulfite process, the removal of hemicellulose takes place during the cooking, simultaneous with dissolving of the lignin. The cooking conditions in that case are highly acidic, and the temperature varies from 140° C. to 150° C., whereby hydrolysis is emphasized. The result, however, is always a compromise with delignification. No higher content of alpha cellulose is obtained. Another drawback is the decrease in the degree of polymerization of cellulose and yield losses, which also limit the potential for hydrolysis. Various improvements have thus been suggested, such as modification of the cooking conditions, and even a prehydrolysis step followed by an alkaline sulfite cooking stage. In spite of developments in connection with sulfite special pulp processes, the number of sulfite pulp mills in operation have decreased, and new developments have not been adopted. The main obstacle in connection with sulfite pulping processes is the complicated and costly recovery processes of the cooking chemicals, particularly of the sulfite itself.

A separate prehydrolysis step permits the desired adjustment of the hydrolysis of hemicelluloses by varying the hydrolysis conditions. In the prehydrolysis-kraft cooking process the necessary delignification is not carried out until a separate second cooking step. The prehydrolysis is carried out either as a water or steam phase prehydrolysis, or in the presence of a catalyst. In the former processes, organic acids liberated from wood during the process perform a major part of the hydrolysis, whereas in the latter processes, small amounts of mineral acid or sulfur dioxide are added to "assist" the prehydrolysis. The delignification step has been a conventional kraft cooking method, where white liquor has been added to the digester and the cooking has been carried out as a single step after removing some or none of the prehydrolysate. One of the drawbacks of this process is e.g., that the neutralized hydrolysate (free hydrolysate left in the digester, as well as immobilized hydrolysate inside the chips) causes consumption of cooking chemicals and loading of the digester.

SUMMARY OF THE INVENTION

One object of the present invention is to provide an improved prehydrolysis-kraft process for the preparation of pulp with a high content of alpha cellulose. In accordance with the present invention, these and other objectives have now been accomplished by the invention of a process for the production of pulp from lignin-containing cellulosic material comprising prehydrolyzing the cellulosic material in a reactor, so as to produce prehydrolyzed cellulosic material and hydrolysate, neutralizing the hydrolysate and the prehydrolyzed cellulosic material in the reactor with alkaline neutralizing liquor so as to produce neutralized hydrolysate and neutralized prehydrolyzed cellulosic material, removing the neutralized hydrolysate from the reactor, and delignifying the neutralized prehydrolyzed cellulosic material with alkaline cooking liquor containing sodium sulfide and sodium hydroxide. If desired, part of the hydrolysate can be recovered before the neutralization step.

According to a preferred embodiment, the prehydrolyzed material is neutralized with fresh cooking liquor, and the neutralized hydrolysate is removed by displacement with spent cooking liquor.

In a preferred embodiment, the alkaline neutralizing liquor also contains sodium hydroxide and sodium sulfide.

In accordance with one embodiment of the process of the present invention, the alkali charge of the alkaline neutralizing liquor is sufficient such that at the end of neutralizing step the reactor has a positive residual alkali concentration as well as a pH above about 9. In a preferred embodiment, the alkali charge comprises from about 5 to 25% active alkali calculated as $Na_2O$ equivalents on dry wood, whereby the positive residual alkali concentration is from about 1 to 20 grams of effective sodium hydroxide per liter.

In accordance with another embodiment of the process of the present invention, the neutralizing step is carried out at a temperature of between about 140° and 160° C., and for a time period of from about 10 to 40 minutes, preferably from about 20 to 30 minutes.

In accordance with another embodiment of the process of the present invention, the process includes removing the neutralized hydrolysate from the reactor by displacement with spent cooking liquor. Preferably, the spent cooking liquor has a residual alkali concentration of between about 10 and 20 grams of effective NaOH per liter. Most preferably, the spent cooking liquor is also at a temperature of between about 150° and 180° C.

In another embodiment of the process of the present invention, the process includes pretreating the neutralized prehydrolyzed cellulosic material prior to the delignifying step by reacting the spent cooking liquor with the neutralized prehydrolyzed cellulosic material under alkaline conditions including a pH of greater than about 9. Preferably, the pretreatment is carried out at a temperature of between about 150° and 180° C. and for a time period of from about 10 to 30 minutes.

In accordance with one embodiment of the process of the present invention in which the lignin-containing cellulosic material is hardwood, the delignifying step is carried out at a temperature of between about 150° and 180° C., preferably between about 150° and 165° C. In accordance with another embodiment in which the lignin-containing cellulosic material is softwood, the delignifying step is carried out at a temperature of between about 155° and 170° C.

In accordance with another embodiment of the process of the present invention, the process includes removing a portion of the hydrolysate from the reactor prior to the neutralizing step.

When compared with traditional prehydrolysis-kraft processes, the present invention offers the following advantages:

A lower consumption of cooking chemicals.

A decrease in the content of the so-called heavy transition metal ions, such as Mn, Cu, Fe, etc., in the cooked pulp. This is achieved because the acidic prehydrolysis step dissolves most of the metal ions, and the dissolved ions are removed before the cooking step. In the traditional process, the metals precipitate back into the cellulose fibers in the alkaline cooking phase. The heavy transition metal content is a critical parameter when applying non-chlorine bleaching chemicals, such as peroxide and ozone which are rapidly destroyed by these metal ions.

A neutralization can be carried out independently, and it is possible to optimize the alkali charge between the neutralization and cooking steps.

The cellulosic materials to be used in the present process are suitably softwood or hardwood, and preferably hardwood such as, for example, eucalyptus species, beech, or birch.

Suitable neutralizing agents for use herein contain caustic soda, and the preferred agent is alkaline kraft cooking liquor, i.e., white liquor. A suitable neutralization time is from about 10 to 40 minutes, preferably from about 20 to 30 minutes, which is enough to mix the digester contents. A suitable neutralization temperature is from about 140° to 160° C. A suitable neutralization alkali charge is about 5 to 20% active alkali, calculated as $Na_2O$ equivalents on dry wood. This results in a neutralization residual alkali concentration of from about 1 to 20 grams of effective NaOH/liter, depending on the wood species and charge utilized.

The removal of neutralized hydrolysate is suitably carried out by displacement with hot black liquor originating from a previous cook. The hot displaced black liquor preferably has a residual alkali concentration of from about 10 to 25 grams of effective NaOH/liter, a pH of from about 12.5 to 13.5, and a temperature of between about 150° to 180° C. The hot black liquor reacts with the wood material, whereby the residual alkali concentration of the hot black liquor is consumed, and the pH is decreased. The displacement with hot displaced black liquor suitably provides a reaction time of from about 10 to 30 minutes. The reaction facilitates the delignification with fresh alkaline cooking liquor in the cooking step.

The displacement is continued with fresh alkaline cooking liquor (white liquor) introducing the alkali cooking charge, which preferably is from about 5 to 15% active alkali calculated as $Na_2O$ equivalents on dry wood. The sulfidity, or the portion of sodium sulfide in the white liquor active alkali is suitably from about 15 to 45%, calculated as $Na_2O$ equivalents. The preferable temperature of the alkaline cooking liquor is from about 150° to 180° C.

The cooking phase is suitably carried out by circulating the cooking liquor for about 10 to 120 minutes, and adjusting the desired cooking temperature by means of high pressure steam, preferably by direct steam injection to the circulating cooking liquor. A suitable cooking temperature is from about 150° to 180° C., preferably from about 150° to 165° C. for hardwoods, and from about 155° to 170° C. for softwoods.

The cooking step is preferably terminated by displacing the hot black liquor by means of a cooler liquor, preferably a wash filtrate having, e.g., a temperature of from about 60° to 90° C. The hot displaced black liquor, which is rich in dissolved solids and sulfur compounds is preferably recovered for re-use, and the heat of the rest of the displaced hot liquor is recovered by heat exchange. The pulp is suitably discharged from the digester by pumping.

The displacements steps are preferably carried out from the bottom to the top of the reactor.

According to the present invention, prehydrolysis-kraft pulp can be delignified to lower residual lignin concentration while maintaining excellent pulp quality in terms of pulp viscosity and alpha cellulose purity, for such end uses as dissolving and other special pulps. Simultaneously the energy economy of the process can be improved.

BRIEF DESCRIPTION OF THE DRAWINGS

The following detailed description of the invention can be more readily understood by reference to the drawings, in which.

DETAILED DESCRIPTION OF THE INVENTION

Figure 1:
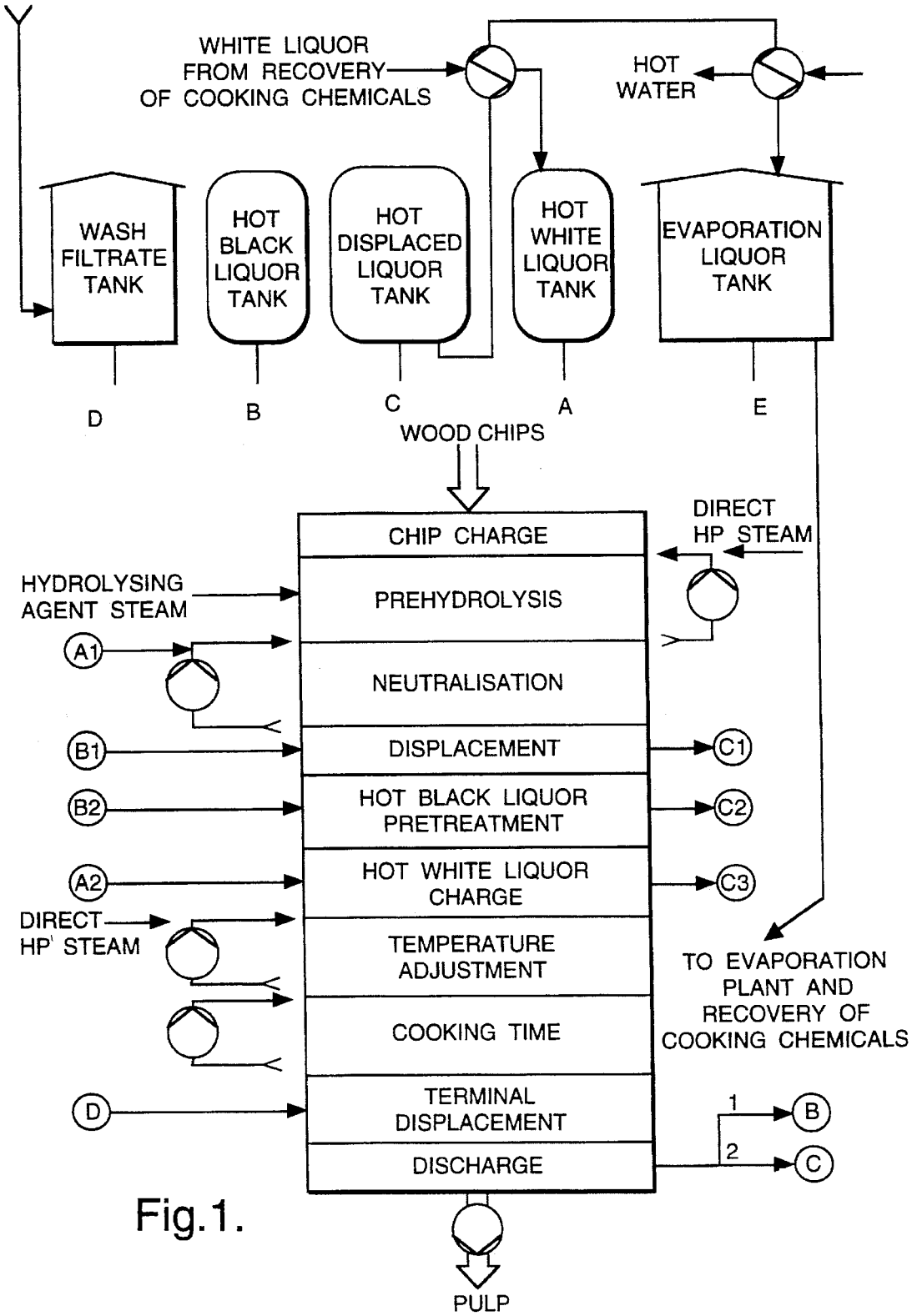
FIG. 1 is a schematic representation of the tanks and liquor transfer sequences according to a process in accordance with the present invention.

In FIG. 1, the cooking steps, the liquor transfer sequences, and the tanks for liquors are set forth.

A prehydrolysis step is first carried out. Suitable prehydrolyzing agents include, for example, water either as circulating liquid or in the steam phase, aqueous solutions of mineral acids such as sulfuric or hydrochloric acid, sulfur dioxide and acid bisulfite cooking liquor. Preferable prehydrolyzing agents for softwoods include water, and for hardwoods water, sulfuric acid or sulfur dioxide. A suitable prehydrolyzing temperature is from about 100° to 160° C. for softwoods and from about 120° to 180° C. for hardwoods. A suitable hydrolyzing time is from about 10 to 200 minutes, preferably from about 20 to 120 minutes.

If desired, part of the hydrolysate can be recovered before the neutralization step, and can be used, for example, for producing ethanol.

After the prehydrolysis step, the present process deviates from prior art prehydrolysis-kraft processes. The prehydrolysis is followed in the case of this invention by a new, individual step; namely, the neutralization step. The primary purpose of this step is to neutralize the hydrolysate remaining in the digester. There is hydrolysate both in the free liquid outside the chips and also trapped and immobilized inside the chips.

In order to carry out the neutralization, fresh hot white liquor A1 is pumped from tank A into the digester so as to displace the hydrolysate from outside the chips. The neutralization is completed by circulating the liquor in the digester, and thus mixing the contents therewith.

In the neutralization step, the contents of the digester are prepared for later delignification, to be carried out by alkaline kraft cooking. Neutralization is achieved by selecting an appropriate neutralizing alkali charge which results in clearly alkaline neutralization end point. The residual alkali concentration is preferably from about 5 to 15 grams effective NaOH/liter. This levels out fluctuations in terms of improper alkali charge and pulp quality due to fluctuating consumption of the single alkali charge by the neutralization step.

In addition to the primary neutralization function, the neutralization step also serves as an alkaline hemicellulose dissolving step. The strong alkali and the high temperature directly dissolve and, on the other hand, degrade hemicellulose by the so-called end-wise peeling reaction. The pulp is thus further purified, which leads to higher pulp viscosity and higher alpha cellulose content. In other words, the neutralization step also becomes, in part, an alkaline extraction stage prior to the cooking step. Therefore the liquor-to-wood ratio in this step is preferably relatively low, such as between about 2.5 and 3.5.

After the neutralization step is completed, hot displaced black liquor B1 from previous cooks is pumped from tank B to the digester. The black liquor B1 begins to displace the neutralized hydrolysate C1 out of the digester. The hydrolysate C1 is fed to the hot displaced liquor tank C.

The removal of the neutralized hydrolysate is advantageous because it removes the dissolved hemicelluloses and their degradation products before the cooking phase, where the presence of these substances would require extra alkali and the delignification selectivity would be compromised. It is also noteworthy that the heavy metal ions, such as Mn, Fe, Cu, and Co, dissolved in the acidic prehydrolysis step, are removed from the digester, thus lowering the disadvantageous metal ion content of the cooked pulp. This facilitates oxidative bleaching of the pulp with oxygen, peroxide and ozone.

The hot black liquor flow to the digester is continued by flow B2 from the tank B, causing the entire contents of the digester to be submerged in the hot black liquor, and the temperature of the digester content to come close to the temperature of the hot black liquor which, in turn, is close to the cooking temperature. The displaced liquor C2 flows to the hot displaced liquor tank C.

The sulfide rich hot black liquor reacts with the wood material and greatly facilitates the delignification with fresh alkaline cooking liquor in the cooking step. The hot black liquor reaction step is carried out for a period of from about 10 to 30 minutes, whereby the residual alkali concentration of the hot black liquor, which is preferably 10 to 25 grams effective NaOH/1, is consumed to preferably about 1 to 10 grams effective NaOH/1. At the end point of the hot black liquor reaction step, the pH of the hot black liquor, which is preferably from about 12.5 to 13.5, is decreased to between about 9.5 and 11.5 in the liquor inside the chips, and between about 11.5 and 12.5 in the free liquor outside the chips. By this method the process conditions are rendered very advantageous for the forthcoming final delignification step.

After the hot black liquor treatment step, hot white liquor A2 from the tank A is pumped to the digester displacing a corresponding volume C3 of the hot black liquor based cooking liquor to the hot displaced liquor tank C. In this manner all of the hot displaced liquor from the digester have been introduced to the hot displaced liquor tank C. The hot liquor from this tank is then led through heat-exchangers to an atmospheric evaporation liquor tank E which serves as a buffer tank discharging the liquor to the evaporation plant, and for recovery of cooking chemicals. It is to be noted that all withdrawn liquors from the initial liquor sequences are collected in one tank, and one liquor heat recovery system thus effectively deposes of all prehydrolyzed dissolved substances from the process before the final delignification in the cooking step.

Hot liquor from the tank C is used to heat white liquor to be pumped to the tank A, and to prepare hot water.

The hot white liquor addition A2 starts the kraft cooking step, i.e. the final delignification step. Due to the high temperature of the hot black liquor, the starting temperature after the white liquor addition A2 is high, i.e., close to the desired cooking temperature. Therefore the heating-up step is in fact a temperature adjustment step, where the need to heat up is preferably only about 1° to 10° C. This can be achieved by simple direct high pressure steam flow to the circulation pipe line, thus avoiding expensive heat-exchangers.

Due to the preparatory hot black liquor treatment, the cooking step is very short. The degree of reaction of the digestion conditions which is required (i.e., reaction temperature and time) is generally determined by the so-called H-factor (see e.g. Pulp and Paper Manufacture, Second Edition Volume 1, The Pulping of Wood, pp. 422–427). Prior art prehydrolysis kraft cooking with hardwoods generally requires about 800 to 1200 H-factor units to complete the delignification, whereas the present prehydrolysis-displacement kraft cooking process needs only about 400 H-factor units to reach the same and even a higher degree of delignification. If the same cooking temperature were to be used, this would mean cutting the cooking time to about 35 to 50% of that of the prior art conventional prehydrolysis-kraft cooking time. The consequence of greatly reduced need for cooking time is that the cooking step can be rendered very mild thus providing improved pulp quality. For instance, if the cooking advantage of H-factor 400, instead of a conventional H-factor requirement of 1000, is converted to a lower cooking temperature, it is then possible to use a cooking temperature of about 159° C. instead of the conventional temperature of about 170° C. This means a dramatic decrease in the rate of random alkaline hydrolysis of the cellulose molecule, and a greatly improved pulp viscosity at the same degree of delignification; i.e., at the same kappa number level.

In today's pulping technology the high unbleached pulp intrinsic viscosity is very valuable, since the new ever increasing compulsory total chlorine free oxidative bleaching sequences compromise the viscosity much more severely than the conventional and more selective chlorine chemicals based bleaching. In this manner, the present invention enables the production of high quality prehydrolysis-kraft pulp by using totally chlorine free bleaching sequences.

The cooking step is terminated by the displacement of the cooking liquor with cool displacement liquor from the tank D, preferably at a temperature of from about 60° to 90° C. This liquor is preferably filtrate from the pulp wash plant. The first portion B of the displaced black liquor consists of pure black liquor, and covers the dry solids rich portion of the displaced liquor. The volume of this displaced portion varies depending on the wood density and the degree the digester is filled, but is usually preferably close to the free liquor volume of the digester, typically between about 60 to 70% of the digester total volume. When the dry solids contents of the displaced hot liquor coming out of the digester starts to drop, the flow is separated as a second flow C directed to the hot displaced liquor tank C. The separation is carried out according to a precalculated volume, or by monitoring the dissolved solids concentration of the displaced liquor. In this manner, the displaced liquor, which is still hot but has been diluted by the displacement liquor, is recovered to the hot displaced liquor tank C which sends its content through heat exchange only to the evaporation liquor tank E and out of the cooking process. The result is that only the dissolved solids and sulfur chemical-rich hot black liquor B is re-used in the displacement of the neutralized hydrolysate and in the subsequent hot black liquor treatment.

The digester is discharged after the terminal displacement step by pumping out the contents thereof.

The following examples further illustrate the invention as compared with conventional processes.

EXAMPLE 1

Production of prehydrolysis-kraft pulp by means of a conventional prehydrolysis-kraft-batch process from Eucalyptus Grandis chips.

Chips were metered into a chip basket positioned in a 35-liter forced circulation digester. The cover of the digester was closed and the prehydrolysis was carried out according to the temperature program by introducing direct high pressure steam into the digester. After the hydrolysis time had passed, the cooking liquor charge was pumped into the digester and the digester circulation started. The cooking was carried out according to the cooking temperature program by heating the digester circulation be means of steam. At the end of the cooking step, the cooking liquor was rapidly cooled and the spent liquor discharged. The pulp was washed in the digester and then discharged from the cooking basket to disintegration for 3 minutes. After the disintegration step, the pulp was dewatered and the total yield determined. Then the pulp was screened on a 0.25 mm slotted screen. Shives were measured and the accept fraction was dewatered and analyzed. The conditions were:

| | |
|---|---|
| Prehydrolysis Step | |
| Wood amount, grams of abs. dry chips | 2000 |
| Prehydrolyzing agent | direct steam |
| Temperature rising, min. | 60 |
| Prehydrolysis temperature, °C. | 170 |
| Prehydrolysis time, min. | 25 |
| Kraft Cooking Step | |
| Active alkali charge, % on wood as $Na_2O$ | 18 |
| White liquor sulfidity, % | 36 |
| Temperature rising time, min. | 60 |
| Temperature, °C. | 170 |
| Cooking time, min. | 60 |
| Cooking H-factor | 1100 |
| Yield, % on wood | 38.4 |
| Shive content, % on wood | 0.1 |
| Kappa number | 10.0 |
| Viscosity SCAN, $dm^3/kg$ | 905 |
| Alkali solubility S5, % | 2.4 |
| Brightness, % ISO | 34.0 |

EXAMPLE 2

Production of prehydrolysis-kraft pulp by means of a conventional prehydrolysis-kraft-batch process from Eucalyptus Grandis chips The experiment was carried out as disclosed in Example 1, but under following conditions:

| | |
|---|---|
| Prehydrolysis Step | |
| Wood amount, grams of abs. dry chips | 3000 |
| Prehydrolyzing agent | direct steam |
| Temperature rising, min. | 60 |
| Prehydrolysis temperature, °C. | 170 |
| Prehydrolysis time, min. | 25 |

-continued

| | |
|---|---|
| Kraft Cooking Step | |
| Active alkali charge, % on wood as $Na_2O$ | 19.5 |
| White liquor sulfidity, % | 36 |
| Temperature rising time, min. | 30 |
| Temperature, °C. | 165 |
| Cooking time, min. | 60 |
| Cooking H-factor | 800 |
| Yield, % on wood | 40.2 |
| Shive content, % on wood | 0.6 |
| Kappa number | 14.1 |
| Viscosity SCAN, $dm^3/kg$ | 1220 |
| Alkali solubility S5, % | 2.7 |
| Brightness, % ISO | 32.3 |

EXAMPLE 3

Production of prehydrolysis-kraft pulp by means of a batch process in accordance with the invention from Eucalyptus Grandis chips.

Chips were metered into a chip basket positioned in a 35-liter forced circulation digester. The cover of the digester was closed and the prehydrolysis was carried out according to the temperature program by introducing direct high pressure steam into the digester. After the hydrolysis time had passed, neutralization white liquor was pumped into the digester and the circulation was started. After the neutralization time had passed the circulation was stopped and hot black liquor was pumped into the digester bottom. The pumping first filled the digester up and then continued as displacement, ousting liquor from the top of the digester. The hot black liquor pumping was stopped after the desired volume was pumped in. The digester circulation was started again, and the desired temperature was reached. After the hot black liquor treatment time had passed, the cooking white liquor charge was pumped into the digester bottom, displacing the hot black liquor from the top of the digester. After the desired alkali charge had entered, the digester circulation was started and the digester heated to the desired cooking temperature.

After the desired cooking time had passed, the cook was terminated as disclosed in the example 1.

| | |
|---|---|
| Prehydrolysis Step | |
| Wood amount, grams of abs. dry chips | 3000 |
| Prehydrolyzing agent | direct steam |
| Temperature rising, min. | 60 |
| Prehydrolysis temperature, °C. | 170 |
| Prehydrolysis time, min. | 25 |
| Neutralization step | |
| Neutralization alkali charge, % on wood as $Na_2O$ | 11.5 |
| Neutralization temperature, °C. | 155 |
| Neutralization time, min. | 15 |
| Hot Black Liquor Displacement And Treatment Step | |
| Hot black liquor residual effective alkali as grams NaOH/l | 20.4 |
| Hot black liquor volume as % of digester volume | 60 |
| Hot black liquor treatment, temperature, °C. | 148 |
| Hot black liquor treatment time, min. | 20 |
| Cooking Step | |
| Active alkali charge, % on wood as $Na_2O$ | 7 |
| White liquor sulfidity, % | 36 |
| Temperature adjustment, °C. | +7 |
| Temperature adjustment time, min. | 10 |
| Cooking temperature, °C. | 160 |

-continued

| | |
|---|---|
| Cooking time, min. | 54 |
| Cooking H-factor | 400 |
| Yield, % on wood | 39.7 |
| Shive content, % on wood | 0.17 |
| Kappa number | 9.1 |
| Viscosity SCAN, $dm^3/kg$ | 1220 |
| Alkali solubility S5, % | 2.8 |
| Brightness, % ISO | 40.0 |

Today's stringent environmental protection issues practically outlaw the use of chlorine compounds in the bleaching of kraft pulp. This will be even more true in the future for high alpha cellulose special pulps which find use for example in hygienic products such as cotton wool. Therefore, the bleaching must be carried out using oxidative bleaching agents such as oxygen, hydrogen peroxide and ozone. As these bleaching methods are significantly less selective and thus compromise the pulp quality significantly more in the bleaching, the unbleached pulp quality must be higher than before. For example, the following requirements have been stated for an unbleached Eucalyptus pulp for total chlorine free bleaching:

| | |
|---|---|
| Kappa number | <10 |
| SCAN viscosity, $dm^3/kg$ | >1200 |
| S5 solubility, % | 2–3.5 |

Before these new requirements, the desired viscosity was generally from about 1050 to 1100 $dm^3/kg$, and could be achieved by delignifying less, in other words cooking to higher kappa number, typically to about 11 to 13 for Eucalyptus grandis. This kind of conventional Eucalyptus prehydrolysis-cook resulted in about a 40% yield.

Example 1 demonstrates the results from a conventional prehydrolysis-kraft batch cook, where the delignification has been extended to kappa number 10. As can be seen, the pulp viscosity is too low. In addition, the pulp yield is quite low, thus increasing the manufacturing costs.

Example 2 demonstrates the results when the conventional prehydrolysis-kraft batch cook has been changed to produce the required pulp viscosity of 1200 dm3/kg by adding alkali charge and cutting down the cooking time and temperature. As a result, the kappa number stays much too high for the above requirements.

Example 3 demonstrates the results when the process is carried out according to the present invention. The required viscosity of 1200 $dm^3kg$ has been reached, while at the same time achieving delignification down to the kappa number of 9.1, and the pulp yield close to the conventional 40% level, which has been the case at about a 50% higher kappa number level of 14. The alkali solubility percentage was well acceptable and fairly constant in all examples.

Another element of proof for the better bleachability of the pulp produced according to the present invention is the brightness of the unbleached pulp. The conventional prehydrolysis pulp in examples 1 and 2 show the brightness of from about 32 to 34% ISO, whereas the pulp in example 3 has the brightness of 40% ISO; i.e., a significant 20% improvement in brightness and bleachability.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A batch process for the preparation of pulp from lignin-containing cellulosic material comprising prehydrolyzing said cellulosic material in a reactor so as to produce prehydrolyzed cellulosic material and hydrolysate, neutralizing said hydrolysate and said prehydrolyzed cellulosic material in said reactor with alkaline neutralizing liquor containing sodium hydroxide and sodium sulfide so as to produce neutralized hydrolysate and neutralized prehydrolyzed cellulosic material and so as to dissolve hemicellulose contained in said cellulosic material, removing said neutralized hydrolysate from said reactor as a separate stream essentially comprising only said neutralized hydrolysate, and delignifying said neutralized prehydrolyzed cellulosic material with alkaline cooking liquor containing sodium sulfide and sodium hydroxide.

2. The process of claim 1 wherein said lignin-containing cellulosic material comprises softwood, and wherein said delignifying step is carried out at a temperature of between about 155° and 170° C.

3. The process of claim 1 including removing a portion of said hydrolysate from said reactor prior to said neutralizing step.

4. The process of claim 1 wherein the alkali charge of said alkaline neutralizing liquor is sufficient such that at the end of said neutralizing step said reactor has a pH above about 9.

5. The process of claim 4 wherein said alkali charge comprises from about 5 to 25% active alkali calculated as $Na_2O$ equivalents on dry wood, whereby said reactor has a positive residual alkali concentration of from about 1 to 20 grams of effective sodium hydroxide per liter.

6. The process of claim 1 wherein said neutralizing step is carried out at a temperature of between about 140° and 160° C. and for a time period of from about 10 to 40 minutes.

7. The process of claim 6 wherein said neutralizing step is carried out for a time period of from about 20 to 30 minutes.

8. The process of claim 1 wherein said lignin-containing cellulosic material comprises hardwood, and wherein said delignifying step is carried out at a temperature of between about 150° and 180° C.

9. The process of claim 8 wherein said delignifying step is carried out at a temperature of between about 150° and 165° C.

10. The process of claim 1 including removing said neutralized hydrolysate from said reactor by displacement with spent cooking liquor.

11. The process of claim 10 wherein said spent cooking liquor has a residual alkali concentration of between about 10 and 20 grams of effective NaOH per liter.

12. The process of claim 11 wherein said spent cooking liquor has a temperature of between about 150° and 180° C.

13. The process of claim 10 including pretreating said neutralized prehydrolyzed cellulosic material prior to said delignifying step by reacting said spent cooking liquor with said neutralized prehydrolyzed cellulosic material under alkaline conditions including a pH of greater than about 9.

14. The process of claim 13 wherein said pretreatment is carried out at a temperature of between about 150° and 180° C. and for a time period of from about 10 to 30 minutes.

15. A batch process for the preparation of pulp from lignin-containing cellulosic material comprising prehydrolyzing said cellulosic material in a reactor so as to produce prehydrolyzed cellulosic material and hydrolysate, neutralizing said hydrolysate and said prehydrolyzed cellulosic material in said reactor with alkaline neutralizing liquor so as to produce neutralized hydrolysate and neutralized prehydrolyzed cellulosic material, removing said neutralized hydrolysate from said reactor as a separate stream essentially comprising only said neutralized hydrolysate by displacement with spent cooking liquor, and delignifying said neutralized prehydrolyzed cellulosic material with alkaline cooking liquor containing sodium sulfide and sodium hydroxide.

16. The process of claim 15 wherein said spent cooking liquor has a residual alkali concentration of between about 10 and 20 grams of effective NaOH per liter.

17. The process of claim 16 wherein said spent cooking liquor has a temperature of between about 150° and 180° C.

18. The process of claim 15 including pretreating said neutralized prehydrolyzed cellulosic material prior to said delignifying step by reacting said spent cooking liquor with said neutralized prehydrolyzed cellulosic material under alkaline conditions including a pH of greater than about 9.

19. The process of claim 18 wherein said pretreatment is carried out at a temperature of between about 150° and 180° C. and for a time period of from about 10 to 30 minutes.

20. A process for the preparation of pulp from lignin-containing cellulosic material comprising prehydrolyzing said cellulosic material in a batch digester so as to produce prehydrolyzed cellulosic material and hydrolysate, neutralizing said hydrolysate and said prehydrolyzed cellulosic material in said batch digester with alkaline neutralizing liquor comprising from about 5 to 25% active alkali calculated as $Na_2O$ equivalents on dry wood so as to produce neutralized hydrolysate and neutralized prehydrolyzed cellulosic material, removing said neutralized hydrolysate from said batch digester, and delignifying said neutralized prehydrolyzed cellulosic material with alkaline cooking liquor containing sodium sulfide and sodium hydroxide.

21. The process of claim 20 wherein said alkaline neutralizing liquor comprises alkaline kraft cooking liquor.

22. The process of claim 20 wherein said alkali charge of said alkali neutralizing liquor is sufficient such that at the end of said neutralizing step said batch digester has a pH above about 9.

23. The process of claim 20 wherein said lignin-containing cellulosic material comprises softwood, and wherein said delignifying step is carried out at a temperature of between about 155° and 170° C.

24. The process of claim 20 including removing a portion of said hydrolysate from said batch digester prior to said neutralizing step.

25. The process of claim 20 wherein said neutralizing step is carried out at a temperature of between about 140° and 160° C.

26. The process of claim 25 wherein said neutralizing step is carried out for a time period of from about 10 to 40 minutes.

27. The process of claim 20 wherein said lignin-containing cellulosic material comprises hardwood, and wherein said delignifying step is carried out at a temperature of between about 150° and 180° C.

28. The process of claim 27 wherein said delignifying step is carried out at a temperature of between about 150° and 165° C.

* * * * *